US005799579A

United States Patent [19]

Schlegel

[11] Patent Number: 5,799,579

[45] Date of Patent: Sep. 1, 1998

[54] METHOD FOR POSITIONING AN ACTUATOR OF A PRINTING MACHINE

[75] Inventor: Christian Schlegel, Dietzenbach, Germany

[73] Assignee: MAN Roland Druckmaschinen AG, Germany

[21] Appl. No.: 758,157

[22] Filed: Nov. 25, 1996

[30] Foreign Application Priority Data

Nov. 25, 1995 [DE] Germany ..... 195 43 964.3

[51] Int. Cl.[6] ..... B41F 31/05; B41F 7/24

[52] U.S. Cl. ..... 101/365; 101/485

[58] Field of Search ..... 101/365, 157, 101/169, DIG. 47, 485, 486, 148, 248, 181; 118/261

[56] References Cited

U.S. PATENT DOCUMENTS 4,510,426 4/1985 Michaels et al. .

5,138,944 8/1992 Rancourt et al. ..... 101/365

FOREIGN PATENT DOCUMENTS 2935489 3/1981 Germany .

3914831 11/1990 Germany .

*Primary Examiner*—J. Reed Fisher

*Attorney, Agent, or Firm*—Leydig, Voit & Mayer, Ltd.

[57] ABSTRACT

A method for positioning actuators inside printing machines is described. In particular, the positioning operations of metering elements, which serve to feed ink, moisture or varnish and interact with a rotating cylinder, are improved. To this end, the metering elements are automatically moved from time to time up to the rotating cylinder and the position resulting in the process is stored as a so-called zero position. The method according to the invention is intended in particular to ensure that the metering element is not set with too high a force relative to the cylinder during future positioning operations. This is done by motion commands being fed to the drive allocated to the metering element so that this drive moves the metering element in two areas, in which the metering element is contiguous to the cylinder and furthermore is in contact with the cylinder. While the position values of the metering element are detected, the corresponding functional relations of the position signals of the metering element are detected as a function of the motion commands of the drive. The zero position value, at which both functions are identical, is stored as the motion command for further positioning operations.

3 Claims, 3 Drawing Sheets

METHOD FOR POSITIONING AN ACTUATOR OF A PRINTING MACHINE

BACKGROUND OF THE INVENTION

1. Technical Field

The present invention relates to a method for positioning an actuator contiguous to a surface with minimal force between the actuator and the surface.

2. Background Art

Printing machines have a multiplicity of remotely adjustable devices, such as, metering devices for damping agent, ink, varnish, as well as, remotely adjustable register-adjusting devices. A feature which such remotely adjustable actuators all have in common is that a motor is allocated to adjust a member (e.g. doctor element, ink-metering element, split or unsplit ink blade) via an adjusting mechanism on the member. A current position of the member is detected by an allocated position indicator integrated, for example, into adjusting mechanisms. The analysis of the position signal of the position indicator and the activation of the motor when approaching an intended position of the actuator are affected in a controller allocated to the motor. The position indicators (position signal indicators) may include sensors which scan in a non-contact manner or even include potentiometers. The motor allocated to the actuator is preferably designed as a synchronous motor or a stepping motor which can be operated step-by-step. The accuracy of a positioning operation of a remotely adjustable actuator depends on the accuracy (resolution) of the signal indicator (position indicator) as well as on the rate at which the signals are detected and processed by the controller.

In offset printing machines, a multiplicity of metering operations are carried out in a remotely adjustable manner. The zonal setting of an ink profile on a rotating ink duct cylinder is an example of such a remotely adjustable metering operations. The zonal setting of the film-thickness profile is effected via individual ink-metering elements, metering eccentrics or parts of a split or unsplit ink blade. An exact ink feed setting is therefore only guaranteed if the indication on an ink-remote-control panel conforms exactly to the ink film thickness set on the ink duct cylinder by the ink-metering element. This also correspondingly applies to remotely adjustable devices for metering damping agents or varnish. For example, it is conventional practice to set, from time to time, the individual ink-metering elements or other metering devices fully against the rotating ink duct cylinder and to evaluate the signal which is associated with this position and which can be read by the signal indicator. This position where the metering device is fully against the ink duct cylinder is known as the zero setting signal for further positioning operations. This signal is stored and serves in combination with the signals of the position indicator and/or control signals (stepping-motor operation) sent to the drive motor and serves as reference value for the further positioning operations.

Especially in the case of the zonal ink-metering devices of sheet-fed offset printing machines, however, manual setting of the ink-metering elements to zero inking is a very time-consuming operation. Consequently, methods and apparatus have already been developed to automate this operation.

It is known from DE 3 914 831 C2 to set an ink-metering element to zero inking by the signal of the position indicator designed as a sensor and which is permanently checked for a change with respect to time. If this signal changes with respect to time, as long as the servomotor allocated to the ink-metering element is in motion, this is an indication that the ink-metering element is not yet contiguous to the surface of the ink duct cylinder. If the sensor signal no longer changes with respect to time, the ink-metering element (i.e., the ink-metering element's tip) has reached the surface of the ink duct cylinder, the allocated motor is switched off and, the current voltage of the position indicator is stored for the further positioning operations. However, such a procedure demands a very high reading and analyzing rate of the signal of the position indicator or sensor. If an ink-metering unit is equipped with a multiplicity of individual metering elements allocated to ink-metering zones, this approach is cost-intensive because of the corresponding hardware requirements.

SUMMARY OF THE INVENTION

The object of the present invention is to provide a method for positioning an actuator, such as a metering element, so that the actuator can be moved into a zero position in a simple and cost-effective manner while avoiding the high case setting forces during these positioning operations.

According to the present invention, the object of the present invention is achieved in a printing apparatus that has a stepper motor that moves a metering element from a starting position relative to a surface in units of a motor step.

In accordance with one aspect of the invention, a method for repeatedly positioning a metering element contiguous to a surface is disclosed. In this method, the number of motor steps associated with a point of intersection is applied to the stepper motor thereby positioning the metering element contiguous to the surface and with minimal force applied to the metering element from the surface. The point of intersection is the intersection of a contact line and a non-contact line in a position-motor step plane. The contact line is the locus of points in the position-motor step plane associated with the metering element when the metering element repeatedly contacts the surface. Each point in the contact line representing the position of the metering element relative to the starting position and the number of motor steps required to move the metering element into contact with the surface. The non-contact line is the locus of points in the position-motor step plane associated with the metering element when the metering element repeatedly moves away from the surface. Each point in the non-contact line representing the position of the metering element relative to the starting position and the number of motor steps required to move the metering element away from the surface.

In accordance with a second aspect of the invention, a method for determining a location relative to the starting position wherein the metering element is contiguous to the surface and has minimal force applied to the metering element by the surface is disclosed. In this method, a metering element is moved into contact with the surface and the position of the metering element relative to the starting position and the number of motor steps required to move the metering element into contact with the surface is stored in memory. Again, the metering element is moved into contact with the surface with increased force and the position of the metering element relative to the starting position and the number of motor steps required to move the metering element into contact with the surface with increased force is stored in memory. Next, the metering element is moved away from the surface and the position of the metering element relative to the starting position and the number of motor steps required to move the metering element away from the surface is stored in memory. Again, the metering element is moved farther away from the surface and the position of the metering element relative to the starting position and the number of motor steps required to move the metering element farther away from the surface is stored in memory. Finally, a point of intersection of a contact line and a non-contact line in a position-motor step plane is stored in memory. The point of intersection defines the number of motor steps required to move the metering element from the starting position to a finishing position which is contiguous to the surface and which applies a minimal force to the metering element from the surface. The contact line includes the locus of points in the position-motor step plane associated with the metering element when the metering element contacts the surface. Similarly, the non-contact line includes the locus of points in the position-motor step plane associated with the metering element when the metering element does not contact the surface.

The invention ensures, especially in the case of a remotely adjustable ink/moisture- or varnish-metering device that the individual metering elements, during the detection of the zero position, are not set against the ductor or the metering cylinder with too high a force during the subsequent positioning operations (i.e., scraping off the ink or the varnish). The method according to the invention enables the detection of a zero position of the actuator. The zero position being the position of the actuator when the actuator is in mechanical contact with the stop or the cylinder with only a small force. For an ink-metering element which interacts with a rotating ductor (ink duct cylinder), this means the zero position of the ink-metering element is when the ink is precisely scraped off and the surface of the ink duct cylinder runs in the blank state. This zero position is then stored for further positioning operations.

The method according to the invention is suitable for any actuator which is moved against a corresponding stop to obtain a zero position with analysis of a corresponding signal can be positioned. If the actuator is designed as an ink-metering element as in the exemplary embodiment, the stop is the ductor or the ink duct cylinder. In an analogous manner, however, a zero position or, in general terms, a reference position of a register actuating drive can also be detected. In this case, a fixed stop is then provided. The method according to the invention also ensures that the electrically detectable position of the position indicator which corresponds to a light contact with the stop is evaluated as a zero position.

The advantage of the method according to the invention is that, especially in an ink-metering unit having a multiplicity of individually adjustable ink-metering elements such as actuators, the actuators are set against the surface of the ink duct cylinder in the same manner with an identical and small force. During the positioning operations (approaching the stored zero position) taking place after the detection of the zero position minimal forces are exerted on the ink ductor by the actuators designed as ink-metering elements.

BRIEF DESCRIPTION OF THE DRAWINGS

An exemplary embodiment of the invention is explained with reference to the drawings, in which.

DETAILED DESCRIPTION OF THE PREFERRED EMBODIMENTS

Figure 1:
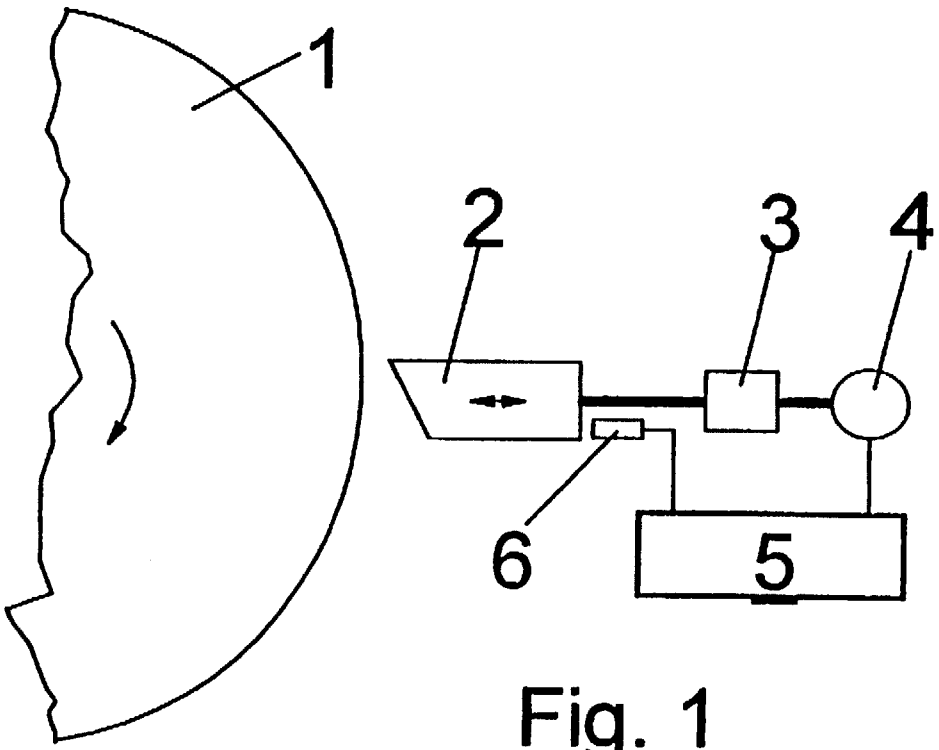
FIG. 1 shows an exemplary embodiment of an apparatus according to the invention at an ink-metering element.

FIG. 1 shows a cylinder 1 rotating in the direction of the arrow as well as a metering element 2 movable in the radial direction of the cylinder 1. Here, the adjusting movement of the metering element 2 is indicated by the double arrow. A motor 4, designed as a stepping motor, is allocated to the metering element 2, the motion of the motor is transmitted via an adjusting mechanism 3, designed in particular as a spindle drive, to the metering element 2 for setting ink-, moisture- or varnish-film thicknesses on the surface of the cylinder 1.

Signals of a motor control 5 are fed to the motor 4. When the motor 4 is designed as a stepping motor, the motor control 5 is consequently designed as a stepping-motor control. In this case, the motor control 5 supplies the winding of the motor 4 with current in such a way that the rotor (not shown) of the motor 4 is rotated by a corresponding number of angular steps. Furthermore, a position indicator 6, designed as a sensor, also interacts with the motor control 5, to which position indicator 6 signals can be fed in accordance with the position of the metering element 2. In this arrangement, the position indicator 6 may be designed as a sensor which detects the position of the metering element 2 in a non-contacting manner. Furthermore, the motor control 5 also has an analyzing circuit 9, which detects and analyzes the signals of the position indicator 6, in the manner explained further below. An example of the analyzing circuit 9 is a microprocessor 10 and associated memory 11.

Since the motor 4 is preferably designed as a stepping motor, positioning operations of the metering element 2 are produced via a step-by-step activation by the motor control 5. Furthermore, the motor control 5 is connected to electronics (not shown) of a remote control panel (not shown) via a bus (not shown). The desired values for positioning operations are input via the remote control panel. In accordance with the linearity of the adjusting mechanism 3, connected in between the motor 4 and metering element 2, a certain number of motor steps of the motor 4 causes the tip of the metering element 2 to move a certain distance towards or away from the surface of the cylinder 1.

Since the motor 4 is designed as a stepping motor, the signal of the position indicator 6 is used to find the zero position of the actuator, designed as metering element 2 in this case. Here, the zero position is stored in the controller (not shown) of the motor control 5 as a counter status of the stepping control for positioning operations.

A desired gap between the tip of the metering element 2 and the surface of the cylinder 1 is now set in such a way that the motor control 5 drives the motor 4 by a certain number of steps—starting from the current position of the metering element 2 as current counter status and the stored counter value corresponding to the zero position. Depending on the direction of rotation of the motor 4, the value of the counter in the motor control 5, which value corresponds to the current position of the metering element, increases/decreases during the positioning operation. By such a use of the motor 4, as stepping motor, neither a temperature dependency nor long-term drift of the position indicator 6 has any effect on the accuracy of the positioning operations.

Figure 2:
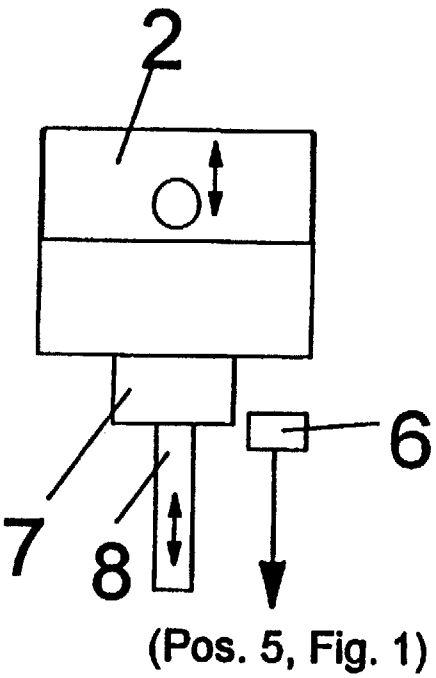
FIG. 2 shows the position indicator, designed as a sensor, at an ink-metering element.

FIG. 2 shows a preferred design of the metering element 2 with the position indicator 6 attached thereto. Here, FIG. 2 shows a top view of the metering element 2. In this case, a movement of the metering element 2 towards the surface (not shown) of the cylinder 1 is effected via a linearly movable shaft 8, to the end of which the metering element 2 is attached. Here, the shaft 8 may be the extension of a spindle drive (not shown) of the adjusting mechanism 3 (FIG. 1).

An annular magnet 7 is attached to the end of the shaft 8 in the transition area between shaft 8 and the end of the metering element 2 remote from the surface of the cylinder 1. This annular magnet 7 executes the movement of the shaft 8 and thus also the movement of the metering element 2 in an analogous manner. A position indicator 6 in the form of a Hall probe is attached at a distance from the annular magnet 7 to a housing (not shown) carrying the adjusting mechanism 3 as well as the motor 4 (FIG. 1). A movement of the metering element 2 and thus also of the annular magnet 7 relative to the position indicator 6 in the form of the Hall probe therefore causes a change in the voltage, which can be tapped, of the position indicator 6.

The method according to the invention will now be explained with reference to FIGS. 3 and 4. First, via the motor control 5, the metering element 2 is moved via the motor 4 by presetting a number of motor steps M so far in the direction of the surface of the cylinder 1 that the metering element 2 bears against the cylinder 1.

Figure 3:
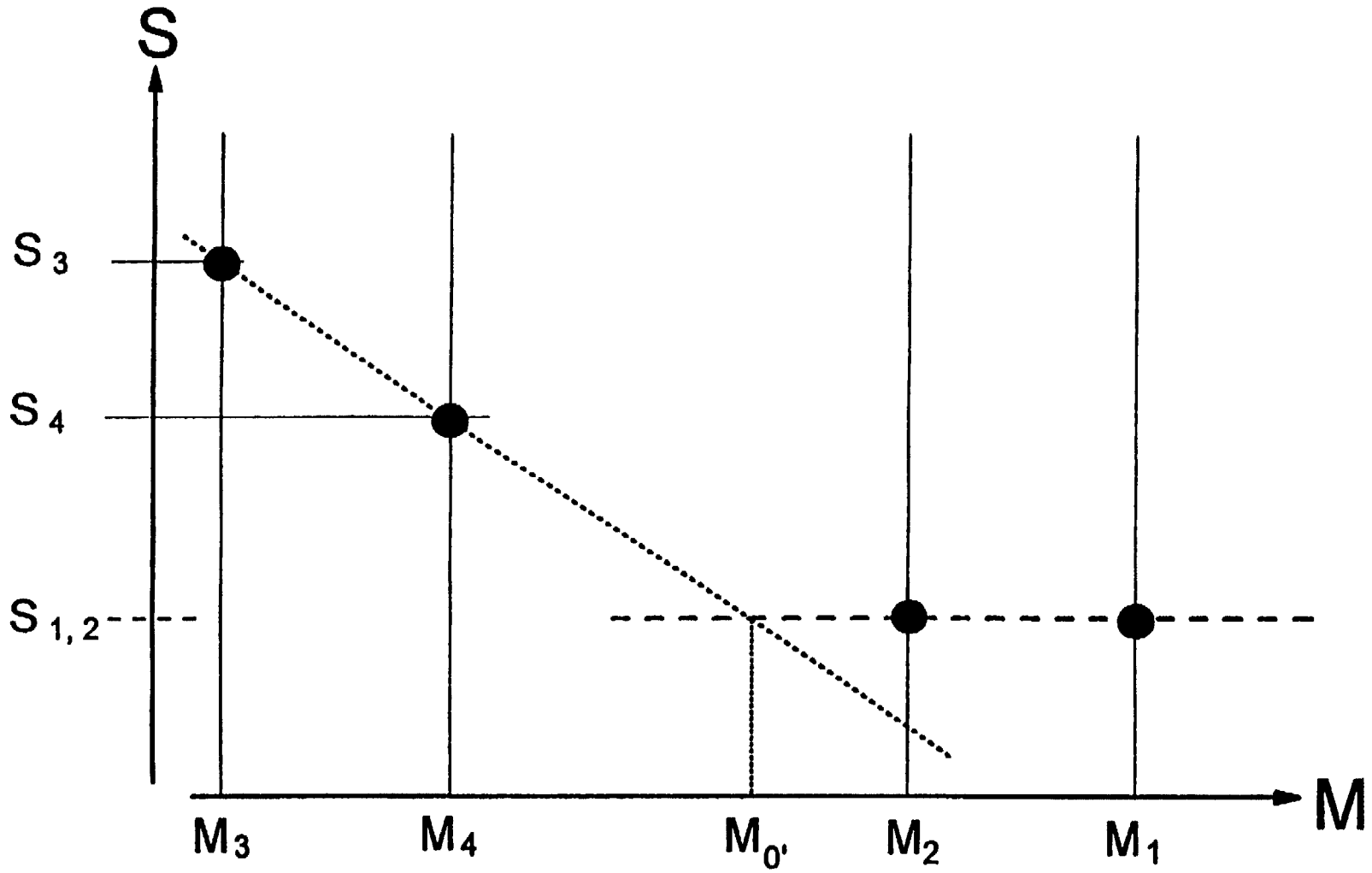
FIGS. 3 and 4 show the signal change of the position indicator as a function of signals of the motor control to illustrate the method according to the invention.
Figure 4:
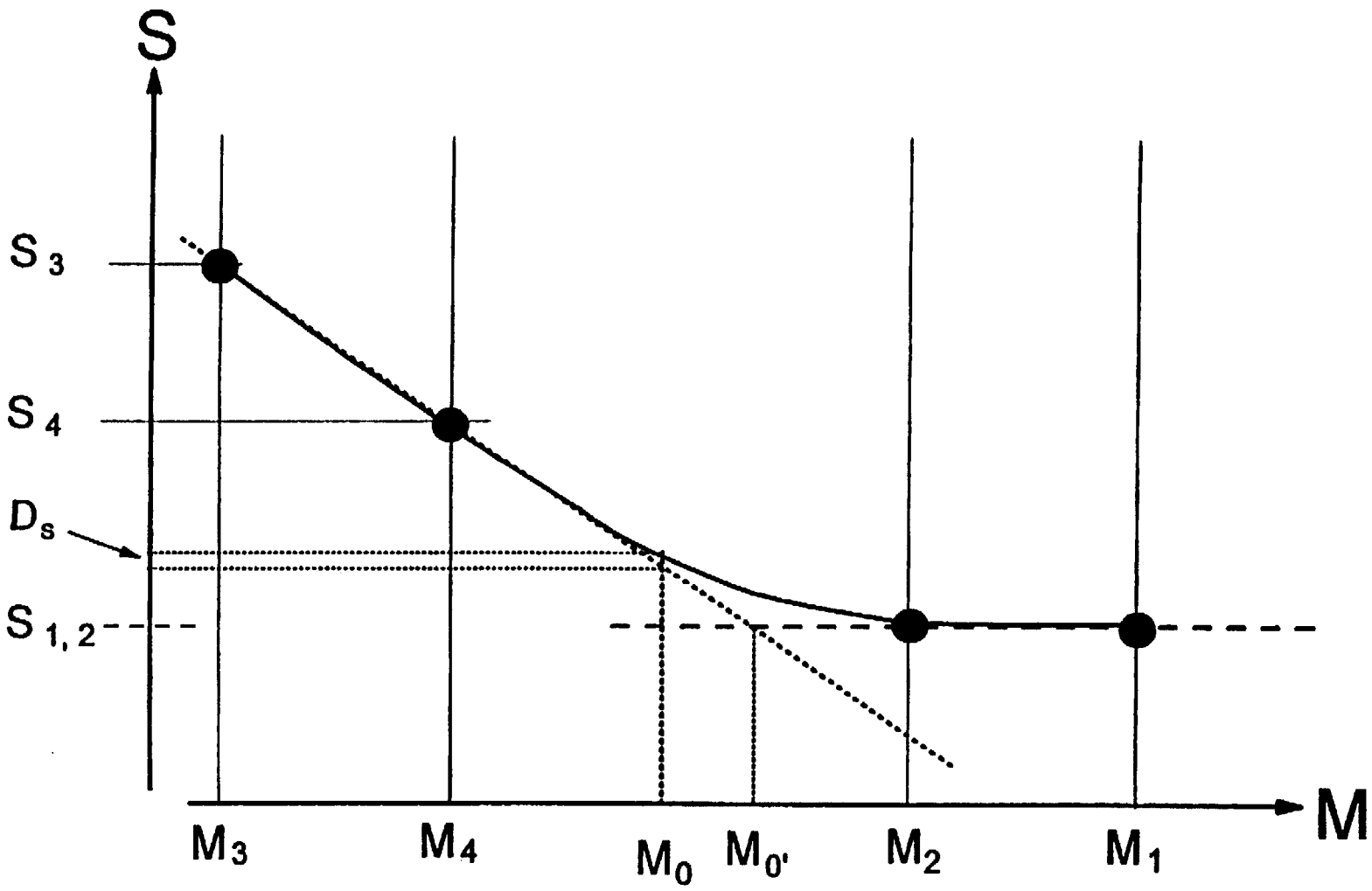

In FIGS. 3 and 4, the abscissae of the diagrams shown are calibrated in number of motor steps M. This means that, starting from a point on the M-axis, a pulse sequence corresponding to the intended number of steps is fed to the motor 4, whereupon the motor 4 performs the corresponding angular rotation or number of revolutions. Here, the ordinates in the diagrams, according to FIGS. 3 and 4, reproduce the changes in the signals S of the position indicator 6. The thin lines drawn vertically, in particular, the distance between two thin lines lying next to one another, correspond here to the scanning cycle of the signal S of the position indicator 6.

First, the motor 4 is driven via the motor control 5 in such a way that the metering element 2 moves towards the cylinder 1. As a result of the scanning cycle of the position indicator 6, the unchanged value $S_{1,2}$ is determined as a signal of the position indicator 6 by the motor control 5 at the motor steps $M_2$ and $M_1$. The metering element 2 has arrived at and is pressed against the cylinder 1. Consequently, the signal S of the position indicator 6 does not change. After the number of motor steps $M_1$ or $M_2$ as well as the associated signal value $S_{1,2}$ are stored, the metering element 2 is thereupon moved via the motor 4 away from the cylinder by a preset number of motor steps M. This number of motor steps M is selected such that the metering element 2 is no longer contiguous to the cylinder 1. After elimination of the play between motor 4 and metering element 2, the motor 4 approaches a first position associated with the signal value $S_4$ and, in one or more subsequent further scanning cycles of the signal of the position indicator 6, a second position in which the metering element 2 does not bear against the cylinder 1. The signal values $S_3$, $S_4$, resulting at the corresponding scanning moments, of the signal S of the position indicator 6 for the positions of the motor steps $M_3$ and $M_4$ are stored. The functional relation S=F(M) can be formed from the value pairs $M_3$, $S_3$ and $M_4$, $S_4$ because of the linearity of the signal S of the position indicator 6 while taking the equation of a straight line as a basis. This linear function S=F(M) therefore describes the change in the signal S of the position indicator 6 as a function of the executed motor steps M in the area in which the metering element 2 does not bear against the cylinder 1.

In the exemplary embodiment according to FIG. 3, a functional relation in the form of a straight line was determined by setting the metering element 2 against the cylinder 1, in which the functional relation of the signal value S of the position indicator 6 no longer changes as a function of a preset number of motor steps M. Therefore in this area: S=const., with $F(M)=S_{1,2}$. In the area in which the metering element 2 is contiguous to the cylinder 1, the signal value S of the position indicator 6 no longer changes as a function of changing motor steps M. The corresponding characteristic is a line parallel to the axis of the motor steps M.

As shown in FIG. 3, these two characteristics intersect at the motor step value $M_{O'}$. The motor step value $M_{O'}$ is stored as a preliminary zero position value. With reference to FIG. 4, an even more accurate zero position having an even smaller setting force can be detected by an additional measurement. The zero position $M_{O'}$ described with reference to FIG. 3 may be stored as the zero position for future positioning operations if the accuracy requirements are not very high. If a metering element 2 is set against the cylinder 1, the motion command corresponding to the value $M_{O'}$ is accordingly preset as a stepping sequence at the motor 4.

FIG. 4 shows, in the form of the thicker line, the curve which can actually be detected for the signal S of the position indicator 6 as a function of preset motion commands M. This line conforms asymptotically to both straight lines. It can be recognized that the slope of the signal S of the position indicator 6 changes when the metering element 2 approaches the cylinder 1.

In a further development of the invention, the metering element 2 can be moved again into the area $M_3$–$M_4$ by corresponding command preset after detecting and storing a first zero position $M_O$, and for the metering element 2 to thereupon be moved again in the direction of cylinder 1 during simultaneous analysis of the signal S. The motor step value $M_O$ is then evaluated and stored as the final zero position, at which motor step value $M_O$ the signal S has a preset minimum deviation DS from the straight line defined by the area $M_3$–$M_4$ and also does not fall below it during the subsequent motion operation. A comparison (subtraction) of the actual signal S with the signal value which can be calculated at the respective motor step value M by the functional relation (equation of a straight line) is thus made while simultaneously allowing for the deviation determined at previous motor step values M. In this way, jumps in the signal S on account of jerky movements of the signal curve resulting when the metering element 2 presses against the cylinder 1 can be differentiated. Here, the final zero position $M_O$, determined in such a way, lies to the left of the value $M_{O'}$, determined beforehand. The use of the final zero position $M_O$, rather than the zero position $M_{O'}$, insures that a smaller setting force of the metering element 2, relative to the cylinder 1, results during subsequent positioning operations. The motor step value $M_O$ has been determined by the procedure according to the invention so that, during subsequent approach of the zero position while taking the motor step value $M_O$ determined as a basis, the metering element 2 is set with the least possible force against the cylinder 1 so that the ink or the varnish is scraped off.

Although shown and described are what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. In a printing apparatus having a stepper motor that moves a metering element from a starting position relative to a surface in units of a motor step (M), a method for positioning the metering element contiguous to the surface comprising: applying a number of motor steps associated with a point of intersection to the stepper motor thereby positioning the metering element contiguous to the surface and with minimal force applied to the metering element from the surface; calculating the point of intersection from the intersection of a contact line and a non-contact line in a position-motor step plane; defining the contact line as a locus of points in the position-motor step plane associated with the metering element when the metering element repeatedly contacts the surface; representing the position of the metering element relative to the starting position by a point corresponding to the number of motor steps required to move the metering element into contact with the surface; defining the non-contact line as a locus of points in the position-motor step plane associated with the metering element when the metering element repeatedly moves away from the surface; representing the position of the metering element relative to the starting position by a point corresponding to the number of motor steps required to move the metering element away from the surface.

2. In a printing apparatus having a stepper motor that moves a metering element from a starting position relative to a surface in units of a motor step (M), a method for determining a location relative to the starting position wherein the metering element is contiguous to the surface and has minimal force applied the metering element by the surface comprising:

moving the metering element into contact with the surface and storing in memory the position of the metering element relative to the starting position and the number of motor steps required to move the metering element into contact with the surface;

moving the metering element into contact with the surface with increased force and storing in memory the position of the metering element relative to the starting position and the number of motor steps required to move the metering element into contact with the surface;

moving the metering element away from the surface and storing in memory the position of the metering element relative to the starting position and the number of motor steps required to move the metering element away from the surface;

moving the metering element yet farther away from the surface and storing in memory the position of the metering element relative to the starting position and the number of motor steps required to move the metering element yet farther away from the surface; and storing in memory a point of intersection of a contact line and a non-contact line in a position-motor step plane, the contact line comprising a locus of points in the position-motor step plane associated with the metering element when the metering element contacts the surface, the non-contact line comprising a locus of points in the position-motor step plane associated with the metering element when the metering element does not contact the surface, the point of intersection defining the number of motor steps required to move the metering element from the starting position to a finishing position which is contiguous to the surface and which applies a minimal force to the metering element from the surface.

3. A method for moving an element in a printing apparatus from a starting position to a surface with a stepper motor comprising: moving the element into contact with the surface a plurality of times, each time with a different number of motor steps; moving the element closer to, but not in contact with, the surface a plurality of times, each time with a different number of motor steps; storing into memory, for each move, an ordered pair consisting of the number of motor steps required and the respective position of the element relative to the starting position; extrapolating a line from the group of ordered pairs stored in memory for which no two ordered pairs have the same position and a different number of steps; extrapolating a line from the group of ordered pairs stored in memory for which at least two ordered pairs have the same position and a different number of steps; determining the intersection of the two lines, in terms of position and number of motor steps required, and; moving the element the number of steps determined from the intersection of the two lines.

* * * * *